US005172896A

United States Patent [19]

Beere

[11] Patent Number: 5,172,896

[45] Date of Patent: Dec. 22, 1992

[54] VISE

[75] Inventor: Richard F. Beere, Waterford, Wis.

[73] Assignee: Beere Tool Company, Inc., Racine, Wis.

[21] Appl. No.: 895,718

[22] Filed: Jun. 9, 1992

[51] Int. Cl.[5] ..... B25B 5/04

[52] U.S. Cl. ..... 269/252; 269/902

[58] Field of Search ..... 269/902, 249, 282, 268, 269/240, 246-247, 250-253

[56] References Cited

U.S. PATENT DOCUMENTS

| | | | |
|---|---|---|---|
| 3,170,708 | 2/1965 | Miller | 269/249 |
| 3,173,674 | 3/1965 | Ringle | 269/249 |
| 3,218,059 | 11/1965 | Andrew | 269/902 |
| 3,306,604 | 2/1967 | Christensen . | |
| 3,575,405 | 8/1968 | Harding | 269/249 |
| 4,005,945 | 2/1977 | Gutman | 269/902 |
| 4,340,211 | 7/1982 | Chiappetti | 269/902 |
| 4,445,678 | 5/1984 | George | 269/902 |
| 4,796,877 | 1/1989 | Musil et al. | 269/902 |
| 4,979,273 | 12/1990 | Friedrickson et al. | 269/249 |

*Primary Examiner*—Robert C. Watson

*Attorney, Agent, or Firm*—Arthur J. Hansmann

[57] ABSTRACT

A vise having a base portion and an upstanding tower thereon and with a movable jaw slidable on the upstanding tower by means of a control screw. Another screw is utilized to hold the upper jaw against the upstanding tower. A pair of V-blocks can be utilized for optimizing the range of utility with regard to sizes of workpieces.

20 Claims, 3 Drawing Sheets

FIG. 7
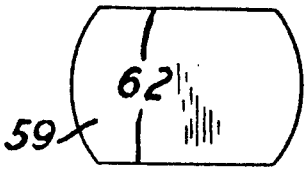
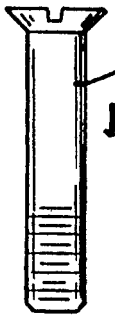
FIG. 8
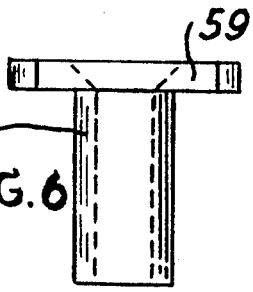
FIG. 6
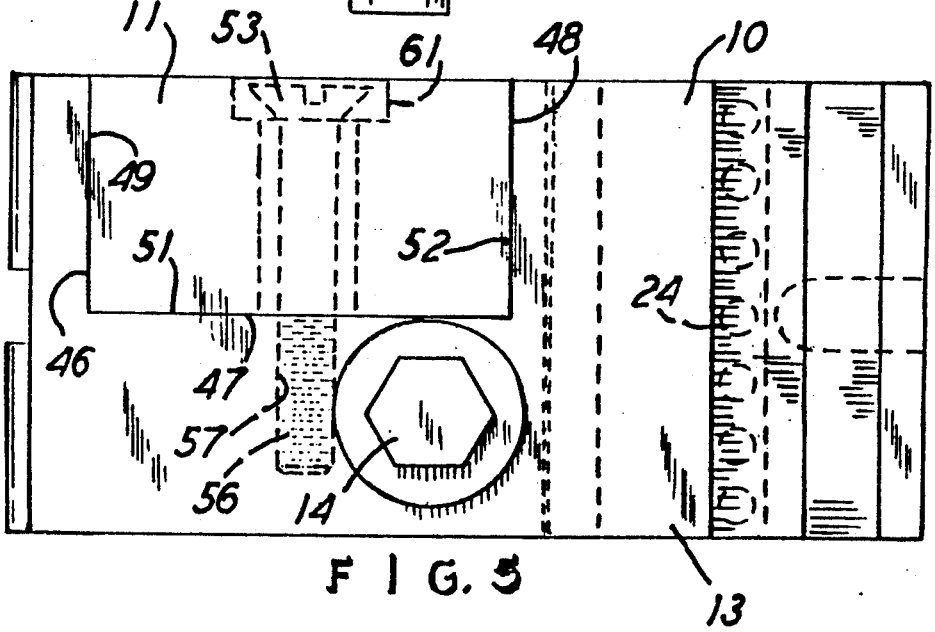
FIG. 5

VISE

This invention relates to a vise, and, more particularly, it relates to an industrial type vise which is extremely firm and secure in holding workpieces.

BACKGROUND OF THE INVENTION

The prior art is already aware of vises in many different designs and configurations. Vises which are constructed for particular use in industry, are intended to be sturdy and accurate in holding workpieces, and some of the prior art vises accomplish these objectives, though they may do so with expensive and numerous parts, and parts which are difficult to manufacture.

An example of a prior art vise which is suitable for industrial use is shown in U.S. Pat. No. 3,306,604. In that example, the vise has a base piece with a separate post thereon and with a movable and clamping jaw slidable on the post for holding workpieces downwardly on the base piece. That vise differs from the one disclosed herein in that it has many more parts, and the parts are expensive and somewhat difficult to manufacture. Where the present invention utilizes many fewer parts in the complete vise, the vise is inherently more accurate in holding the workpiece, and of course it is less expensive to manufacture and more easily operated and maintained because of the fewer pieces required. Also, the present invention improves upon the prior art in providing a vise which exerts a maximum force on the workpiece for the accurate and secure holding of the workpiece. That is, the devise is of a sturdy construction, and, for its overall dimensions or size, it has optimum capacity, and in fact a capacity beyond that which is produced by prior art vises of similar overall dimensions.

Further, the present invention provides for an arrangement of V-blocks, such as only two blocks which can be utilized for accommodating workpiece sizes from only a fraction of an inch to multiples of an inch. In actuality, this is accomplished by utilization of only two V-blocks which can be simultaneously mounted on the vise for holding the very small parts, and one upper V-block can be removed when the workpiece is of a larger size. Still further, the V-blocks can be shifted on the base piece for accommodating particular positioning of workpieces, such as shouldered workpieces. The shifting or offsetting of the V-block on the workpiece also allows for more clearance for drill chucks or the like which are used in connection with the vise holding the workpiece which is being drilled.

Still further, the vise of this invention can be readily and easily positioned in the secure workpiece clamping position, and in fact only one screw needs to be maneuvered in order to clamp and release the workpiece when the vise is utilized for its maximum holding security in force.

BRIEF DESCRIPTION OF THE DRAWINGS

FIG. 5 is a top plan view of the vise shown in FIG. 1.

FIGS. 6, 7, and 8 are parts of the vise shown herein.

DETAILED DESCRIPTION OF THE PREFERRED EMBODIMENT

Figure 4:
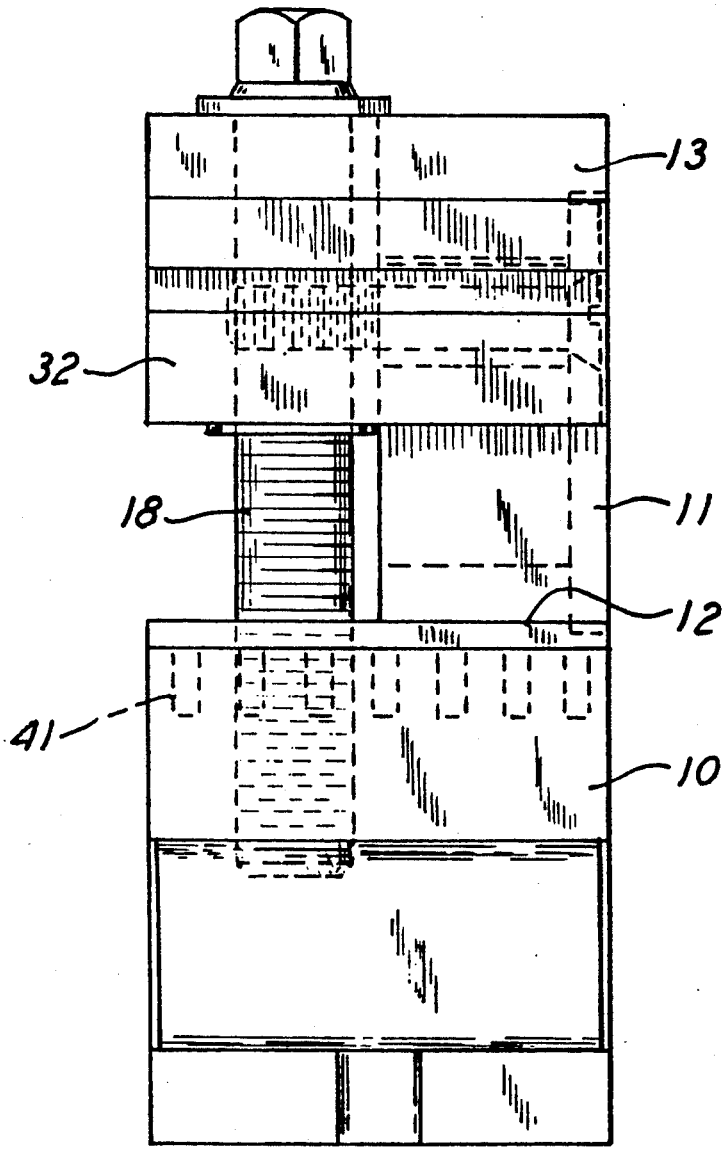
FIG. 4 is a front elevational view of the vise shown in FIG. 1.

The drawings show a base piece 10 which has an integral and upstanding tower or post portion 11 actually offset to one side of a table top 12 of the base 10, and FIG. 4 shows that arrangement.

An upper jaw 13 is up-and-down slidably mounted on the tower 11, and a control screw 14 is attached to the jaw 13 by means of the upper screw head 16 and the washer 17 which is locked onto the stem 18 of the screw 14. The screw 14 is threaded into a threaded opening 19 in the base piece 10.

The aforementioned arrangement is such that upon rotation of the screw 14, the ring 17 will upwardly support the upper jaw 13 and permit it to lower in accordance with the threading action of the screw 14 into the base 10 through the threaded hole 19. In that manner, the upper jaw 13 moves up and down on the tower 11 and away from and toward the base piece table top or bed 12. In this showing, it will be seen that the upper jaw 13 has parallel upper and lower surfaces coincident with head 16 and washer 17.

Figure 1:
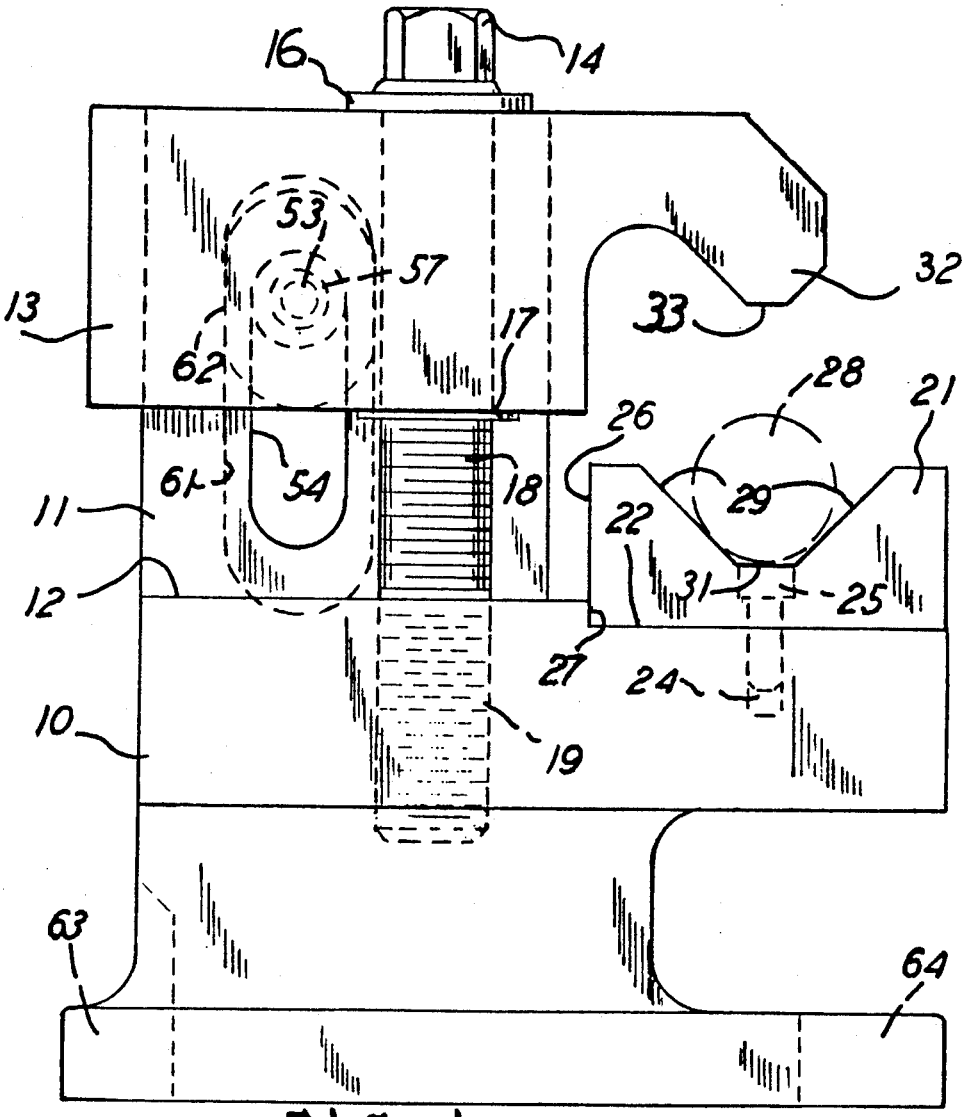
FIG. 1 is a side elevational view of a vise of this invention.
Figure 2:
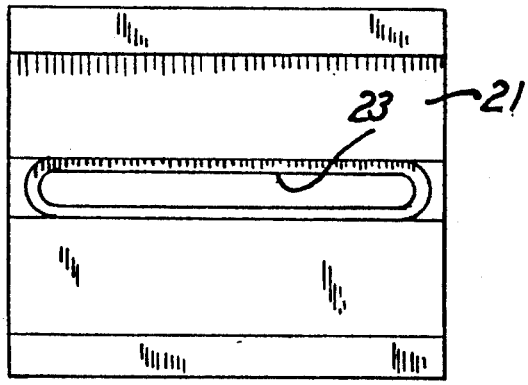
FIG. 2 is a top plan view of the V-block shown in FIG. 1.

A V-block 21 is supported on the bed section 22 which is stepped down from the horizontal plane of the table top 12, as seen in FIG. 1. The V-block 21 is releasably attached to the base piece 10 by means of a screw 25 which extends through an elongated slot 23 in the base block 21, as shown in FIG. 2. Of course the screw 25 threads into a single threaded opening 24 in the base piece 10, and the V-block side surface 26 is in snug abutment with the shoulder 27 which is between the two planar surfaces 12 and 22, as seen in FIG. 1. In that arrangement the V-block 21 is securely held by means of the single screw 25, though it can be slid along the surface 22 by virtue of the elongated slot 23. As such, a workpiece 28, shown in dash lines in FIG. 1, can be projected offset or laterally of the vise shown herein, and yet be supported underneath by the V-block 21 which can be shifted partway off the surface 22, again, by virtue of the slot 23. Of course the V-block 21 has spaced-apart legs or surfaces 29 which nest the cylindrical workpiece 28, in the arrangement of holding a cylindrically-shaped workpiece 28. The V-block 21 also has a planar portion 31 which is intervening between the legs or planar surfaces 29, as shown in FIGS. 1 and 2.

Figure 3:
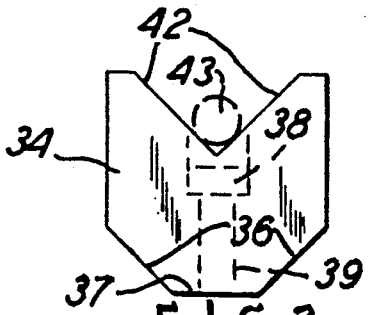
FIG. 3 is an end elevational view of a second V-block utilized in this invention.

FIGS. 1, 4, and 5 also show that the upper jaw 13 has an offset portion 32 which extends downwardly toward the center axis of the workpiece 28, and it has a planar portion 33 which would rest downwardly on the top of the cylindrical workpiece 28 when the vise is in the clamping position. The effect of the offset 32 is such that it can extend between the legs 29 and thus extend closely to the surface 31 and thereby hold a small workpiece. This arrangement is particularly significant when another V-block 34 is nested into the first V-block 21 such that the sides 36 of the V-block 34 rest on the respective sides 29 of the V-block 21 in a snug and thus stable and immovable arrangement when fastened downwardly, and the surface 37 is then clear of surface 31 of the V-block 21. Such fastening is achieved by means of a screw 38 which extends through screw holes 39 in the V-block 34 and thus the extended screws 38 can go into threaded holes 41 spaced along the base piece bed surface 22, as shown in FIG. 4. Again, that arrangement permits the upper jaw offset portion 32 to penetrate between the planar surfaces 42 of the V-block 34 and to thereby hold a very small workpiece, such as shown in dotted lines in FIG. 3. In that arrangement, with only two V-blocks 21 and 34, the vise is capable of holding workpieces of the large size as 28 or of the smaller size as 43. Further, the V-block 34 can be adjustably positioned relative to the base 10 and the V-block 21 to thus have the screw 38 extend into any selected one of the screw holes 41 in the base piece 10, and, again, the workpiece can therefore be offset and yet upwardly supported by means of the shifted V-block 34.

The post or tower 11 is shown to be rectangular in cross-sectional or plan shape, as seen in FIG. 5, and the upper jaw 13 is in contact with the post three sides 46, 47, and 48, and this is achieved by the three mating and matching upper jaw planar sides 49, 51, and 52 which respectively are of the corresponding lengths of the tower three sides and are in snug and sliding contact therewith. Of course the six planar sides mentioned are all made with a finished surface so that they are in snug sliding contact.

To secure the upper jaw 13 on the tower 11, a screw 53 extends through an upright and elongated slot 54 in the tower 11, as seen in FIG. 1. Also, the screw 53 has its inner end 56 snugly threaded into the upper jaw 13 at the threaded opening 57 in the upper jaw 13.

A T-shaped guide spacer 58 extends into the tower slot 54 to be snug therewith but to be slidable up and down in the slot 54. The guide has a head 59 which is received in an enlarged recess 61 in the tower 11 for thus further stabiliizing and guiding the sliding relationship of the guide 58 up and down in the tower slot 54. To further enhance the guiding relationship, the head 59 has flat sides 62 which are in sliding contact with the respective sidewalls of the tower enlarged recess 61, as perhaps best indicated in FIG. 1.

The upper jaw 13 can be positioned in the desired spaced relationship with the workpiece 28, that is, with the V-block on the base 10, and that positioning is accomplished by rotation of the screw 14. Throughout this positioning, the screw 53 holds the upper jaw 13 snugly against the planar surface 47 of the tower 11. Of course the tower surfaces 46 and 48 also guide the upper jaw 13 and cause it to retain its parallelism and alignment relative to the tower 11.

The base 10 has openings 63 and 64 therein, and these openings render the entire vise capable of being mounted in the so-called vertical alignment shown, and also the vise can be turned 90 degrees and thus mounted in a horizontal position, all by means of clamping screws which would extend through the slots 63 and 64.

What is claimed is:

1. A vise comprising a base piece having an upstanding tower, a V-block supported on said base piece, an upper jaw slidably supported on said tower and being in snug sliding contact up and down on said tower, said tower having two diametrically opposite sides and a third side intermediate said two sides and all sides being with respect to the upstanding longitudinal central axis of said tower, said upper jaw extends in snug sliding contact with all three said sides of said tower, a fastener connected to said upper jaw and being slidably guided on said tower for slidably securing said upper jaw to said tower, said fastener extending through said tower in a position which forces said upper jaw toward said third side of said tower, said upper jaw having a portion disposed in alignment with said V-block for holding a workpiece against said V-block, and a screw interconnected between said upper jaw and said base piece and being threadedly engaged with said base piece for effecting the up and down movement of said upper jaw upon rotation of said screw.

2. The vise as claimed in claim 1 wherein said tower is rectangular in its cross section perpendicular to the upstanding longitudinal axis of said tower to thereby present a total of four sides, and said upper jaw includes three sides which are each in snug sliding contact with a respective one of said three sides of said tower sides, and said fastener extends through the one of said tower's four sides, other than any one of said three sides, for the slidable guiding of said upper jaw.

3. The vise as claimed in claim 1 wherein said V-block has two spaced-apart legs for receiving a workpiece therebetween and said upper jaw includes a portion offset relative to said V-block and with said portion being shaped for extending into the space between said two spaced-apart legs for contacting a workpiece disposed entirely within said space.

4. The vise as claimed in claim 1, including a second V-block and being of a size smaller than the first-mentioned said V-block for nesting in the latter said V-block, and screws for releasably retaining both said V-blocks to said base piece.

5. The vise as claimed in claim 1, wherein said V-block has a slot therethrough, and said base piece has a threaded opening therein, and a screw extending through said slot and into said threaded opening for adjustably securing said V-block to said base piece.

6. The vise as claimed in claim 5, including a second V-block and being of a size smaller than the first-mentioned said V-block for nesting in the latter said V-block, and a screw for releasably retaining said second V-block to said base piece.

7. The vise as claimed in claim 1, wherein said tower has an upright slot therein, and said fastener is a threaded member extending through said upright slot and being threadedly connected with said upper jaw.

8. The vise as claimed in claim 2, wherein said tower has an upright slot therein, and said fastener is a threaded member extending through said upright slot and being threadedly connected with said upper jaw.

9. A vise comprising a base piece having an upstanding tower, a V-block supported on said base piece, an upper jaw partly surrounding said tower and being slidably supported on said tower in snug sliding contact up and down on said tower, said tower having two diametrically opposite sides and a third side intermediate said two sides and all sides being with respect to the upstanding longitudinal central axis of said tower, said upper jaw extends in snug sliding contact with all three said sides of said tower, a fastener connected between said tower and said upper jaw for slidably securing said upper jaw to said tower, said fastener extends through said tower in a position which forces said upper jaw toward said third side of said tower, said upper jaw having a portion disposed in alignment with said V-block for holding a workpiece against said V-block, and a screw interconnected between said upper jaw and said base piece and being threadedly engaged with said base piece for effecting the up and down movement of said upper jaw upon rotation of said screw.

10. The vise as claimed in claim 9 wherein said tower is rectangular in its cross section perpendicular to the upstanding longitudinal axis of said tower to thereby present a total of four sides, and said upper jaw includes three sides which are each in snug sliding contact with a respective one of said three sides of said tower sides, and said fastener extends through the one of said tower's four sides, other than any one of said three sides, for the slidable guiding of said upper jaw.

11. A vise comprising a base piece having an upstanding tower, a V-block supported on said base piece, an upper jaw slidably supported on said tower and being in snug sliding contact up and down on said tower, said upper jaw having two parallel surfaces extending transversely to said upstanding tower, a fastener connected to said upper jaw and being slidably guided on said tower for slidably securing said upper jaw to said tower, said upper jaw having a portion disposed in alignment with said V-block for holding a workpiece against said V-block, a screw extending through said two parallel surfaces of said upper jaw and into said base piece and being threadedly engaged only with said base piece, and a projection affixed to said screw at each of said two parallel surfaces and being in respective contact with said two parallel surfaces for effecting the up and down movement of said upper jaw upon threaded rotation of said screw in said base piece.

12. The vise as claimed in claim 11 wherein said tower is rectangular in its cross section perpendicular to the upstanding longitudinal axis of said tower to thereby present four sides, and said upper jaw includes three sides which are each in snug sliding contact with a respective one of said three sides of said tower sides, and said fastener extends through the one of said tower's four sides, other than any one of said three sides, for the slidable guiding of said upper jaw.

13. The vise as claimed in claim 12, wherein said tower has an upright slot therein, and said fastener is a threaded member extending through said upright slot and being threadedly connected with said upper jaw.

14. The vise as claimed in claim 11, wherein said tower has an upright slot therein, and said fastener is a threaded member extending through said upright slot and being threadedly connected with said upper jaw.

15. A vise comprising a base piece having an upstanding tower, a V-block supported on said base piece, an upper jaw slidably supported on said tower and being in snug sliding contact up and down on said tower, said upper jaw having two parallel surfaces extending transversely to said upstanding tower, said tower having two diametrically opposite sides and a third side intermediate said two sides and all sides being with respect to the upstanding longitudinal central axis of said tower, said upper jaw extends in snug sliding contact with all three said sides of said tower, a fastener connected to said upper jaw and being slidably guided on said tower for slidably securing said upper jaw to said tower, said fastener extending through said tower in a position which forces said upper jaw toward said third side of said tower, said upper jaw having a portion disposed in alignment with said V-block for holding a workpiece against said V-block, a screw extending through said two parallel surfaces of said upper jaw and into said base piece and being threadedly engaged only with said base piece, and a projection affixed to said screw at each of said two parallel surfaces and being in respective contact with said two parallel surfaces for effecting the up and down movement of said upper jaw upon threaded rotation of said screw in said base piece.

16. A vise comprising a base piece having an upstanding tower, a V-block supported on said base piece, an upper jaw slidably supported on said tower and being in snug sliding contact up and down on said tower, said upper jaw having two parallel surfaces extending transversely to said upstanding tower, a fastener connected to said upper jaw and being slidably guided on said tower for slidably securing said upper jaw to said tower, said tower being rectangular in its cross section perpendicular to the upstanding longitudinal axis of said tower to thereby present four sides, and said upper jaw includes three sides which are each in snug sliding contact with a respective one of said three sides of said tower sides, said fastener extending through the one of said tower's four sides, other than any one of said three sides, for the slidable guiding of said upper jaw, said upper jaw having a portion disposed in alignment with said V-block for holding a workpiece against said V-block, a screw extending through said two parallel surfaces of said upper jaw and into said base piece and being threadedly engaged only with said base piece, and a projection affixed to said screw at each of said two parallel surfaces and being in respective contact with said two parallel surfaces for effecting the up and down movement of said upper jaw upon threaded rotation of said screw in said base piece.

17. A vise comprising a base piece having an upstanding tower rectangular in its cross section perpendicular to the upstanding longitudinal axis of said tower to thereby present four sides, a V-block supported on said base piece, an upper jaw having three sides which are each in snug sliding contact with a respective one of three sides of said tower sides to have said upper jaw slidably supported on said tower and being in snug sliding contact up and down on said tower, a fastener connected to said upper jaw and extending through the one of said tower's four sides, other than any one of said three sides, and being slidably guided on said tower for slidably securing said upper jaw to said tower, said upper jaw having a portion disposed in alignment with said V-block for holding a workpiece against said V-block, and a screw interconnected between said upper jaw and said base piece and being threadedly engaged with said base piece for effecting the up and down movement of said upper jaw upon rotation of said screw.

18. A vise comprising a base piece having an upstanding tower, a V-block supported on said base piece, a second V-block of a size smaller than the first-mentioned said V-block for nesting in the latter said V-block, screws for releasably retaining both said V-blocks to said base piece, an upper jaw slidably supported on said tower and being in snug sliding contact up and down on said tower, a fastener connected to said upper jaw and being slidably guided on said tower for slidably securing said upper jaw to said tower, said upper jaw having a portion disposed in alignment with said V-block for holding a workpiece against said V-block, and a screw interconnected between said upper jaw and said base piece and being threadedly engaged with said base piece for effecting the up and down movement of said upper jaw upon rotation of said screw.

19. The vise as claimed in claim 18, wherein said V-block has a slot therethrough, and said base piece has a threaded opening therein, and a screw extending through said slot and into said threaded opening for adjustably securing said V-block to said base piece.

20. A vise comprising a base piece having an upstanding tower with an upright slot therein, a V-block supported on said base piece, an upper jaw slidably supported on said tower and being in snug sliding contact up and down on said tower, a threaded fastener extending through said upright slot and being threadedly connected to said upper jaw and being slidably guided on said tower for slidably securing said upper jaw to said tower, said upper jaw having a portion disposed in alignment with said V-block for holding a workpiece against said V-block, and a screw interconnected between said upper jaw and said base piece and being threadedly engaged with said base piece for effecting the up and down movement of said upper jaw upon rotation of said screw.

* * * * *